US010672235B2

(12) United States Patent
Susaki et al.

(10) Patent No.: US 10,672,235 B2
(45) **Date of Patent: *Jun. 2, 2020**

(54) SETTLEMENT APPARATUS

(71) Applicant: TOSHIBA TEC KABUSHIKI KAISHA, Shinagawa-ku, Tokyo (JP)

(72) Inventors: Akiko Susaki, Tokyo (JP); Norifumi Shishido, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,107

(22) Filed: Jul. 10, 2019

(65) Prior Publication Data

US 2019/0333347 A1 Oct. 31, 2019

Related U.S. Application Data

(63) Continuation of application No. 16/152,496, filed on Oct. 5, 2018, now Pat. No. 10,395,485, which is a (Continued)

(30) Foreign Application Priority Data

Nov. 20, 2015 (JP) ..... 2015-228160

(51) Int. Cl.
*G07F 19/00* (2006.01)
*G07G 1/00* (2006.01)

(Continued)

(52) U.S. Cl.
CPC ..... *G07G 1/0018* (2013.01); *G07D 1/00* (2013.01); *G07D 1/02* (2013.01); *G07D 5/04* (2013.01);

(Continued)

(58) Field of Classification Search
CPC ..... G07G 1/0018; G07D 11/16; G07D 11/14; G07D 1/00; G07D 1/02; G07D 5/04;

(Continued)

(56) References Cited

U.S. PATENT DOCUMENTS 6,021,883 A 2/2000 Casanova et al.
6,318,536 B1 11/2001 Korman et al.

(Continued)

FOREIGN PATENT DOCUMENTS

CN 2603460 2/2004
CN 1877647 12/2006

(Continued)

OTHER PUBLICATIONS

Japanese Decision to Grant a Patent for Japanese Patent Application No. 2015-228160 dated Jan. 31, 2017.

(Continued)

*Primary Examiner* — Karl D Frech
(74) *Attorney, Agent, or Firm* — Amin, Turocy & Watson, LLP

(57) ABSTRACT

A settlement apparatus contains a case body; a coin inserting slot, provided at the case body, which receives a deposited coin; a coin depositing/dispensing device, provided in the case body, which stores the deposited coin received through the coin inserting slot and dispenses the stored coin; and a concaved shape money placement portion, arranged at the case body, which has a money placement surface on which the deposited coin which is received by the coin inserting slot is temporarily placed, wherein the money placement surface is connected to the coin inserting slot in a width direction of the case body and is formed flatly, and the money placement portion is arranged across a center of the case body in the width direction.

11 Claims, 6 Drawing Sheets

Related U.S. Application Data continuation of application No. 15/347,851, filed on Nov. 10, 2016, now Pat. No. 10,121,332.

(51) Int. Cl.

| | |
|---|---|
| ***G07D 11/14*** | (2019.01) |
| ***G07D 11/16*** | (2019.01) |
| ***G07D 1/00*** | (2006.01) |
| ***G07D 5/04*** | (2006.01) |
| ***G07D 1/02*** | (2006.01) |
| ***G07D 11/00*** | (2019.01) |
| ***G07F 1/02*** | (2006.01) |

(52) U.S. Cl.

CPC ..... *G07D 11/009* (2013.01); *G07D 11/14* (2019.01); *G07D 11/16* (2019.01); *G07F 1/02* (2013.01); *G07F 19/202* (2013.01); *G07F 19/205* (2013.01)

(58) Field of Classification Search

CPC ..... G07D 11/009; G07F 1/02; G07F 19/202; G07F 19/205

USPC ..... 235/379

See application file for complete search history.

(56) References Cited

U.S. PATENT DOCUMENTS

| | | | | |
|---|---|---|---|---|
| 6,983,836 | B2 | 1/2006 | Adams et al. | |
| 8,141,772 | B1 | 3/2012 | Folk et al. | |
| 8,443,958 | B2 | 5/2013 | Blake et al. | |
| 8,607,957 | B2 | 12/2013 | Blake et al. | |
| 8,684,160 | B2 | 4/2014 | Hallowell et al. | |
| 8,870,073 | B2 | 10/2014 | Detwiler | |
| 8,950,566 | B2 | 2/2015 | Hallowell et al. | |
| 8,959,026 | B2 | 2/2015 | Kim et al. | |
| 10,121,332 | B2 | 11/2018 | Susaki et al. | |
| 10,395,485 | B2 * | 8/2019 | Susaki | |
| 2009/0236201 | A1 | 9/2009 | Blake et al. | |
| 2011/0099105 | A1 * | 4/2011 | Mennie ..... | G06K 9/033 705/41 |
| 2012/0199438 | A1 | 8/2012 | Taniike | |

FOREIGN PATENT DOCUMENTS

| | | |
|---|---|---|
| CN | 103049960 | 4/2013 |
| CN | 103198553 | 7/2013 |
| JP | 5-075878 | 10/1993 |
| JP | 6-348957 | 12/1994 |
| JP | 2000-057416 | 2/2000 |
| JP | 2000-132727 | 5/2000 |
| JP | 2001-310512 | 11/2001 |
| JP | 2007-80226 | 3/2007 |
| JP | 2007-140586 | 6/2007 |
| JP | 2008-083869 | 4/2008 |
| JP | 2008-130009 | 6/2008 |
| JP | 2008-217737 | 9/2008 |
| JP | 2009-059306 | 3/2009 |
| JP | 2010-033494 | 2/2010 |
| JP | 2012-048319 | 3/2012 |
| JP | 2012-103984 | 5/2012 |
| JP | 2012-185580 | 9/2012 |
| JP | 2012-185639 | 9/2012 |
| JP | 2013-008398 | 1/2013 |
| JP | 2013-41544 | 2/2013 |
| JP | 2013-045353 | 3/2013 |
| JP | 2013-114300 | 6/2013 |
| JP | 2014-052714 | 3/2014 |
| JP | 2014-052722 | 3/2014 |
| JP | 2014-127106 | 7/2014 |
| JP | 2014-149881 | 8/2014 |
| JP | 2014-170301 | 9/2014 |
| JP | 2014-174566 | 9/2014 |
| JP | 2015-014921 | 1/2015 |
| JP | 2015-026240 | 2/2015 |
| JP | 2015-026241 | 2/2015 |
| JP | 2015-026272 | 2/2015 |
| JP | 2015-088035 | 5/2015 |
| JP | 2015-130117 | 7/2015 |
| JP | 2015-141586 | 8/2015 |
| JP | 2015-156138 | 8/2015 |
| JP | 5811295 | 10/2015 |

OTHER PUBLICATIONS

Japanese Decision to Grant a Patent for Japanese Patent Application No. 2016-117913 dated Jan. 31, 2017.

Japanese Decision to Grant a Patent for Japanese Patent Application No. 2016-124213 dated Jan. 31, 2017.

Extended European Search Report for European Patent Application No. 16198797.9 dated Apr. 3, 2017.

Japanese Office Action for Japanese Patent Application No. 2017-018738 dated Mar. 21, 2017.

Japanese Office Action for Japanese Patent Application No. 2017-112959 dated Jul. 4, 2017.

Japanese Office Action for Japanese Patent Application No. 2017-113703 dated Jul. 4, 2017.

Japanese Office Action for Japanese Patent Application No. 2017-113704 dated Jul. 4, 2017.

Japanese Office Action for Japanese Patent Application No. 2017-175647 dated Dec. 12, 2017.

Non-Final Office Action for U.S. Appl. No. 15/347,851 dated Sep. 7, 2017.

Chinese Office Action for Chinese Patent Application No. 201610353891.8 dated Aug. 10, 2018.

Non-Final Office Action for U.S. Appl. No. 16/152,496 dated Dec. 10, 2018.

Chinese Office Action for Chinese Patent Application No. 201610353891.8 dated Mar. 21, 2019.

U.S. Appl. No. 16/152,496, filed Oct. 5, 2018.

U.S. Appl. No. 15/347,851, filed Nov. 10, 2016.

Japanese Decision to Grant a Patent for Japanese Patent Application No. 2019-081234 dated Feb. 18, 2020.

* cited by examiner

SETTLEMENT APPARATUS

CROSS-REFERENCE TO RELATED APPLICATIONS

This application is a Continuation of application Ser. No. 16/152,496 filed on Oct. 5, 2018, which is a Continuation of application Ser. No. 15/347,851 filed on Nov. 10, 2016, the entire contents of both of which are incorporated herein by reference.

This application is based upon and claims the benefit of priority from Japanese Patent Application No. 2015-228160, filed Nov. 20, 2015, the entire contents of which are incorporated herein by reference.

FIELD

Embodiments described herein relate generally to a settlement apparatus.

BACKGROUND

Conventionally, in Point Of Sales (POS) terminals used in supermarkets, an area for temporarily placing and checking money received from customer before the money is stored into a drawer is provided. Such an area is called an examination tray or a money-checking tray. Provision of the area enables a store clerk (casher) to avoid troubles at the time of receiving cash and giving change to perform register operations quickly and correctly.

In recent years, self-checkout apparatuses (self-checkout registers) are used in a supermarkets to enable a customer himself or herself to carry out a settlement without an operation by the store clerk. Such self-checkout registers include a coin inserting slot capable of receiving a plurality of coins at one time so as to allow the customer to complete a coin inputting operation at one time.

Incidentally, some customers who use the self-checkout register described above take out coins from their wallets to place them on a flat area of the self-checkout register, and check or confirm the coins to input needed coins to the coin inserting slot at the time of the settlement.

In a case of such a manner described above, the customer is required to collect the needed coins again and then inputs the coins to the coin inserting slot after placing and confirming the coins on the flat area of the self-checkout register.

DESCRIPTION OF THE DRAWINGS

FIG. 6 is a functional block diagram illustrating functions relating to a settlement processing; and.

DETAILED DESCRIPTION

According to an embodiment, a settlement apparatus contains a case body; a coin inserting slot, provided at the case body, which receives a deposited coin; a coin depositing/dispensing device, provided in the case body, which stores the deposited coin received through the coin inserting slot and dispenses the stored coin; and a concaved shape money placement portion, arranged at the case body, which has a money placement surface on which the deposited coin which is received by the coin inserting slot is temporarily placed, wherein the money placement surface is connected to the coin inserting slot in a width direction of the case body and is formed flatly, and the money placement portion is arranged across a center of the case body in the width direction.

Hereinafter, a detailed description of an embodiment of a settlement apparatus will be given with reference to the accompanying drawings. The embodiment described herein is an example in which the present embodiment is applied with a settlement terminal of a self-checkout apparatus as a settlement apparatus on which a customer carries out a sales registration and a settlement by himself or herself.

Figure 1:
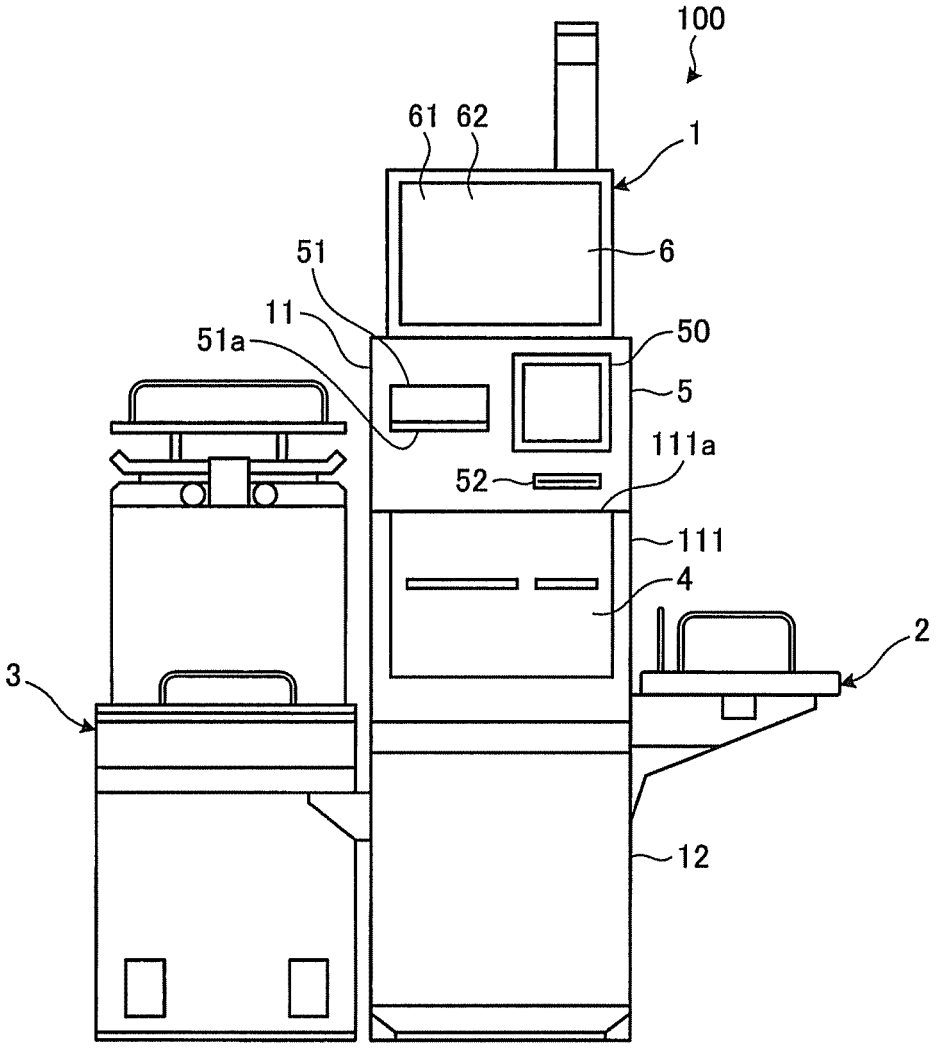
FIG. 1 is a front view illustrating an appearance of a self-checkout apparatus according to an embodiment.

FIG. 1 is a front view illustrating an appearance of a self-checkout apparatus 100 according to the embodiment. As illustrated in FIG. 1, the self-checkout apparatus 100 includes a settlement terminal 1, a basket rack 2, and a bagging rack 3. The settlement terminal 1 includes a depositing/dispensing unit 4, a reading unit 5, a display/operation unit 6, and a control unit 7 (see FIG. 5) that controls the respective components.

The settlement terminal 1 includes a first case body 11 and a second case body 12. The first case body 11 includes a door 111 that can be opened and closed. The door 111 is turned in an up and down direction about a hinge 111*a*. The first case body 11 accommodates therein a bill change machine (bill depositing/dispensing device) 41 and a coin change machine (coin depositing/dispensing device) 42 (see FIG. 2) that form the depositing/dispensing unit 4. The second case body 12 accommodates therein the control unit 7.

The reading unit 5 includes a scanner 50 that reads an appearance of a commodity or a symbol (such as a barcode) attached to the commodity for specifying the commodity. The reading unit 5 also includes a printer 51 that prints a receipt relating to a commodity sales data processing executed by the control unit 7. The printer 51 includes a receipt dispensing table 51*a* projecting from the first case body 11 to support a dispensed receipt. The receipt dispensing table 51*a* is a protrusion with a protruding shape provided in a manner that it projects from the first case body 11. Furthermore, the reading unit 5 includes a card reader 52 that reads a credit card used for executing a settlement processing by the control unit 7.

The display/operation unit 6 includes a monitor 61 and a touch panel 62. The monitor 61 displays images in accordance with a control performed by the control unit 7. The touch panel 62 is provided on the surface of the monitor 61 to output information according to a position touched by an operator to the control unit 7.

The basket rack 2 is an article placing table used as a place on which a basket is placed when an operation of picking up the commodity from the basket and holding the commodity over the reading unit 5 is performed. The basket rack 2 is provided on one of the sides of the settlement terminal 1.

The bagging rack 3 is a table on which the commodity is placed to be bagged after scanning the commodity. The bagging rack 3 is provided on the other side (the opposite side of the basket rack 2) of the settlement terminal 1.

Figure 2:
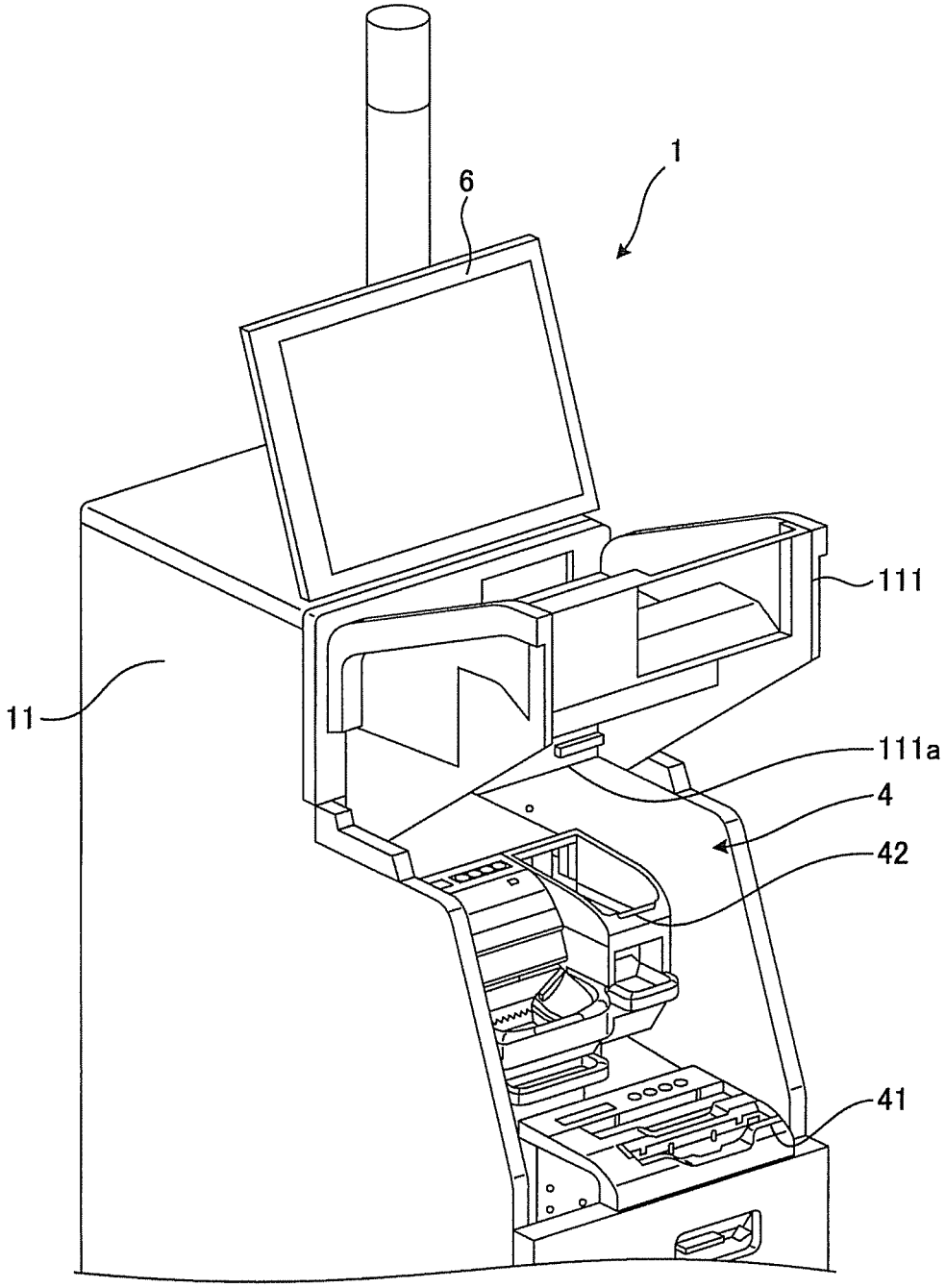
FIG. 2 is a perspective view illustrating an appearance of a settlement terminal in a state in which a door of the terminal is opened.
Figure 3:
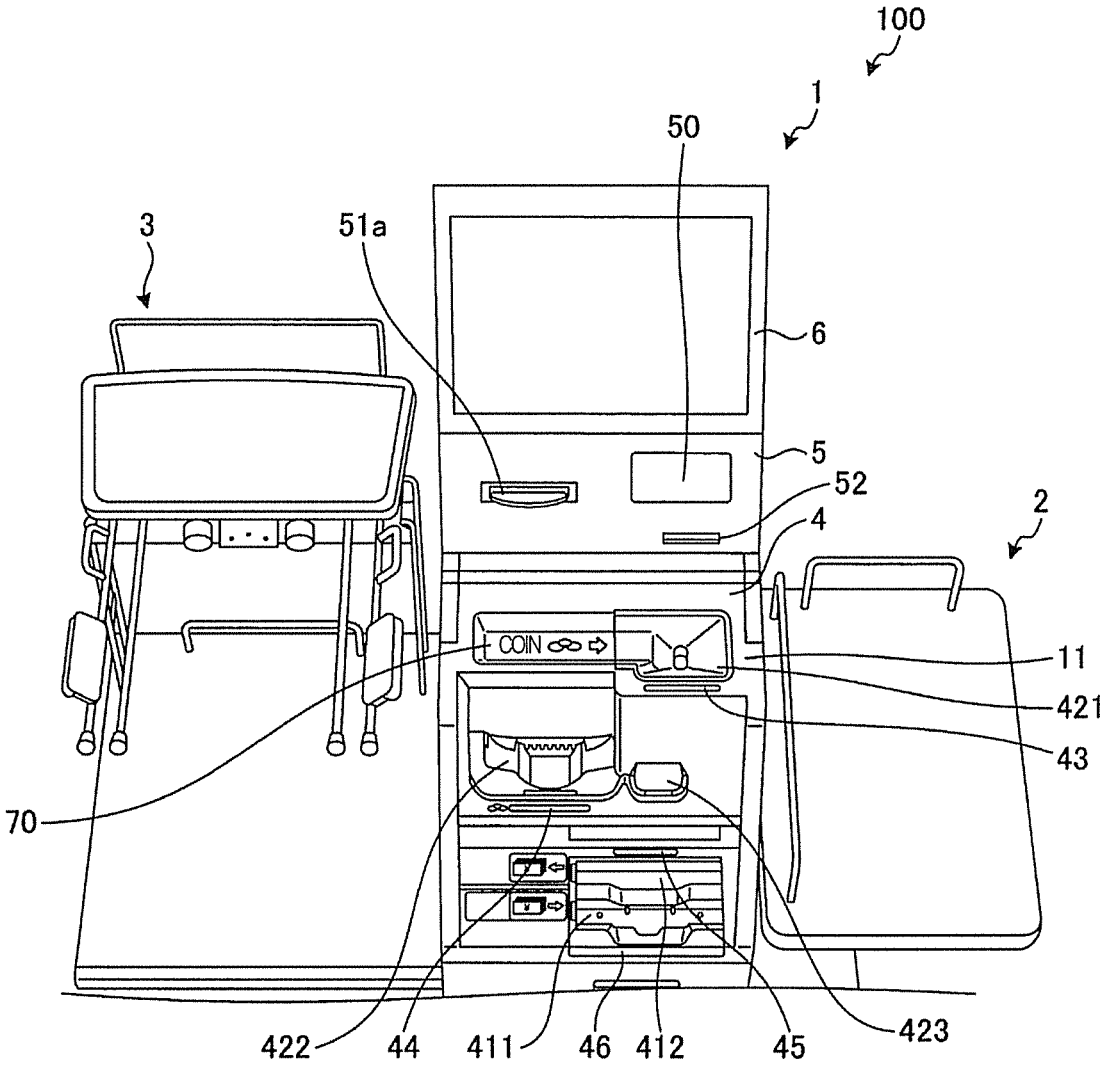
FIG. 3 is a perspective view illustrating an appearance of the self-checkout apparatus when viewed from an upper side.

FIG. 2 is a perspective view illustrating an appearance of the settlement terminal 1 in a state in which the door 111 thereof is opened. As illustrated in FIG. 3, the first case body 11 opens the inside thereof by turning the door 111 upward to expose the bill change machine 41 and the coin change machine 42. The bill change machine 41 and the coin change machine 42 are accommodated in the first case body 11 in an overlaid manner such that the bill change machine 41 is located below the coin change machine 42.

The bill change machine 41 discriminates whether or not received bills are genuine money to store them and outputs bills as a change. The coin change machine 42 discriminates whether or not received coins are genuine money to store the genuine money, and outputs coins as a change. The bill change machine 41 and the coin change machine 42 respectively provide information relating to an amount of the stored money to the control unit 7. The bill change machine 41 and the coin change machine 42 respectively receive information relating to an amount to be dispensed as a change from the control unit 7.

The control unit 7 collectively controls the respective components provided in the settlement terminal 1 (the depositing/dispensing unit 4, the reading unit 5, and the display/operation unit 6). The control unit 7 acquires a code information from the reading unit 5. The control unit 7 outputs information to be displayed on the monitor 61 of the display/operation unit 6 and acquires information relating to an operation on the touch panel 62 performed by the operator. Furthermore, the control unit 7 recognizes a deposit to the depositing/dispensing unit 4 and provides an instruction for dispensing change to the depositing/dispensing unit 4.

FIG. 3 is a perspective view illustrating an appearance of the self-checkout apparatus 100 when viewed from the above thereof. As illustrated in FIG. 3, the first case body 11 includes an inserting slot 421 of coins (coin inserting slot), through which coins are input to the coin change machine 42, on one of the end sides of an upper surface thereof.

In addition, the first case body 11 (depositing/dispensing unit 4) includes a coin dispensing dish 422 and a reject dish 423, and a bill inserting slit 411 and a bill dispensing slit 412 in order in a stepwise manner from the far side (deep side) at which a money placement portion 70 (see FIG. 4) and the coin inserting slot 421 are provided toward the front side. A surface on which the coin inserting slot 421 is provided corresponds to an upper stage, a surface on which the coin dispensing dish 422 and the reject dish 423 are provided corresponds to an intermediate stage located below the upper stage, and a surface on which the bill inserting slit 411 and the bill dispensing slit 412 are provided corresponds to a lower stage located below the intermediate stage. The coin dispensing dish 422 located on the intermediate stage is located at a front side in a depth direction of the first case body 11 beyond the money placement portion 70 and the coin inserting slot 421 located on the upper stage. The bill inserting slit 411 and the bill dispensing slit 412 located on the lower stage are located at the front side in the depth direction of the first case body 11 beyond the coin dispensing dish 422 located on the intermediate stage. As described above, with the arrangement in which various inserting slots and dispensing slits (dispensing dish) are located in a stepwise manner, the operator can see all the inserting slots and the dispensing slit (dispensing dish) that are arranged from the far side to the front side.

The coin dispensing dish 422 receives coins dispensed from the coin change machine 42. The reject dish 423 receives coins (rejected coins) that cannot be accommodated in the coin change machine 42, such as a deformed coin, a foreign coin, and a counterfeit coin. A positional relationship of the coin inserting slot 421, the coin dispensing dish 422, and the reject dish 423 depends on a structure of the coin change machine 42.

As illustrated in FIG. 3, the coin dispensing dish 422 is provided at an end opposite to the end of the settlement terminal 1 in the width direction at which the coin inserting slot 421 is provided. Since the coin inserting slot 421 and the coin dispensing dish 422 are provided such that positions those of are shifted from each other in the height direction, the width direction, and the depth direction as described above, a satisfactory visibility and an operability to the coin dispensing dish 422 are achieved. The reject dish 423 is aligned with the coin dispensing dish 422 below the coin inserting slot 421.

The bill inserting slit 411 is used to deposit bills to the bill change machine 41 therethrough. The bill dispensing slit 412 is used to dispense bills from the bill change machine 41 therethrough. A positional relationship between the bill inserting slit 411 and the bill dispensing slit 412 depends on a structure of the bill change machine 41.

In addition, LEDs 43 to 46 for informing an operation procedure and an error are provided in the vicinities of the coin inserting slot 421, the coin dispensing dish 422, the reject dish 423, the bill inserting slit 411, and the bill dispensing slit 412, respectively. Positions where the LEDs 43 to 46 are provided are not particularly limited as long as the LEDs 43 to 46 are provided in the vicinities of the respective components. The number and arrangement of the LEDs 43 to 46 are also not particularly limited.

Figure 4:
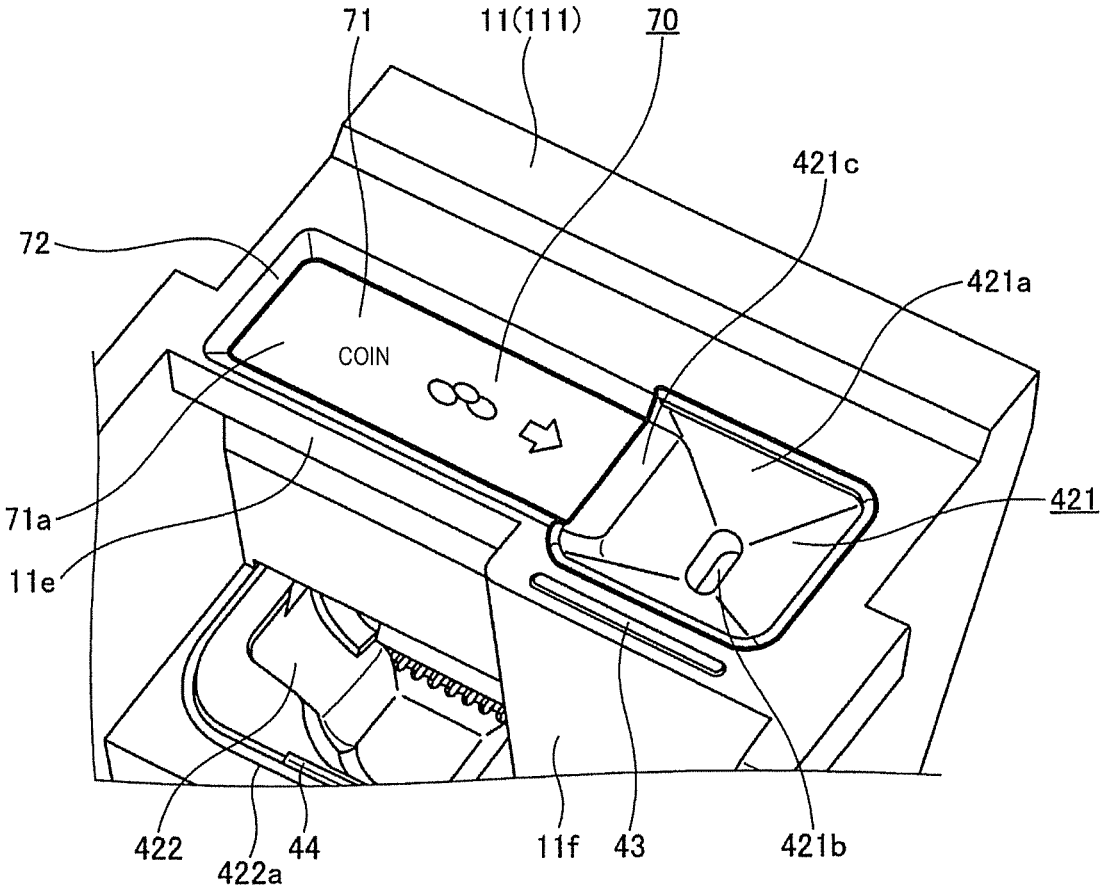
FIG. 4 is a plan view illustrating an appearance of a vicinity of a coin inserting slot.

Next, configurations of the coin inserting slot 421 and the vicinity of the coin inserting slot 421 are described. FIG. 4 is a plan view illustrating an appearance in the vicinity of the coin inserting slot 421. As shown in FIG. 4, the coin inserting slot 421 includes a funnel-shaped oblique surface 421*a* that is inclined downward from the outside toward the inside and a hole 421*b* that is provided at the bottom of the oblique surface 421*a*. The hole 421*b* is formed in an elongated shape toward a customer who stands in front of the settlement terminal 1. A longitudinal direction of the hole 421*b* is a direction intersecting the direction in which the coins are made to slide toward the coin inserting slot. The dimension of the hole 421*b* in a width direction (the direction in which the coins are made to slide toward the coin inserting slot) orthogonally intersecting the elongated direction is set to such a size that a plurality of overlaid coins may pass therethrough, and is shorter than the dimension of the hole 421*b* in the longitudinal direction. With such a configuration, the coin inserting slot 421 may collectively receive a plurality of coins.

In addition, the door 111 of the first case body 11 includes the money placement portion 70 formed at a position adjacent to the coin inserting slot 421 in the width direction of the settlement terminal 1. The money placement portion 70 is typically called as an examination tray or a money-checking tray. The money placement portion 70 is located across both sides of the first case body 11 in the width direction from the center of the first case body 11. The money placement portion 70 is provided for customer to visually check or confirm money, to be used for the settlement, which are took out from his or her wallet and put on the money placement portion 70, when the settlement processing of the settlement terminal 1 is performed by the customer.

More specifically, the money placement portion 70 includes a planar-shaped money placement surface 71 on which money (coins and bills) is placed and a guide wall 72. The shape of the money placement surface 71 is not limited to the planar shape and may be a curved recessed surface shape. A sheet 71*a* made of plastic or metal is attached to the money placement surface 71. The sheet 71*a* is provided in order to prevent the money placement portion 70 from being stained and damaged by the money placed, to cover a connecting portion between the money placement portion 70 and the coin inserting slot 421, and to display explanation of a use method of the money placement portion 70.

The guide wall 72 is provided at an edge of the money placement surface 71 except for a side that is connected to the coin inserting slot 421. The guide wall 72 projects upward beyond the money placement surface 71 and supports a side portion of money (coins, in particular) placed on the money placement surface 71. Such a guide wall 72 is formed as a part of the first case body 11.

In contrast, the coin inserting slot 421 includes, at a position connected to the money placement surface 71, a planar-shaped coupling portion 421*c* that continues from the oblique surface 421*a*. It is needless to say that the coupling portion 421*c* is formed in accordance with the shape of the money placement surface 71 if the money placement surface 71 is curved in a concaved shape.

The money placement portion 70 formed in a concaved shape on the door 111 of the first case body 11 as described above is provided at such a position as to interfere with the receipt dispensing table 51*a* of the printer 51 in a state in which the door 111 is turned upward to expose the inside of the first case body 11. The depth of the recessed portion of the money placement portion 70 is set to such a depth as to be able to avoid collision against the receipt dispensing table 51*a*.

As illustrated in FIG. 4, a part of the vicinity of the money placement portion 70 of the first case body 11 is set back so that the coin dispensing dish 422 is exposed to a camera (not illustrated) or customer to easily see the coin dispensing dish 422. The first case body 11 includes a front surface 11*e* at the front side of the money placement portion 70 along the width direction of the first case body 11 in FIG. 4. The length of the front surface 11*e* in the width direction of the first case body 11 is substantially the same as the length of the money placement portion 70 in the width direction of the first case body 11. The first case body 11 includes a front surface 11*f* at the front side of the coin inserting slot 421 along the width direction of the first case body 11. The front surface 11*e* is configured to be located at the far or deep side in the depth direction of the first case body 11 beyond the front surface 11*f*. An edge 422*a* of the coin dispensing dish 422 at the front side in the depth direction of the first case body 11 is located at the front side in the depth direction of the first case body 11 beyond the front surface 11*e*.

Furthermore, an LED 47 (see FIG. 5) acing as an irradiating unit that emits light for irradiation is provided below the money placement portion 70 above the coin dispensing dish 422 at the first case body 11.

The settlement terminal 1 includes a sensor 73 (see FIG. 5) acting as a detection unit that detects an object (wallet or coins) placed on or near the money placement surface 71. Examples of the sensor 73 include an optical sensor, a magnetic sensor, and an image sensor. The optical sensor is arranged such that an optical axis of the optical sensor is trained on the money placement surface 71, to determine that there is an object on the money placement surface 71 if the optical axis is blocked. The magnetic sensor is arranged at a position on the rear side of the money placement surface 71, for example, to determine that there is an object on the money placement surface 71 if metal is detected. The image sensor is arranged above the money placement surface 71, for example, to determine that there is an object on the money placement surface 71 by image recognition.

With such a configuration, the money placement portion 70 enables input of coins to the connected coin inserting slot 421. Specifically, a customer takes out money (coins and bills) used for payment from his or her wallet and puts the money on the money placement surface 71 of the money placement portion 70 to check or confirm the money when the payment processing of the settlement terminal 1 is performed. Then, the customer carries the put coins to the coin inserting slot 421 to carry out a payment such that the coins slide on the money placement surface 71 toward the coin inserting slot 421 and finally fall into the coin inserting slot 421. At this time, the guide wall 72 of the money placement portion 70 prevents the coins from falling from the money placement surface 71 by supporting side portions of the coins.

Figure 5:
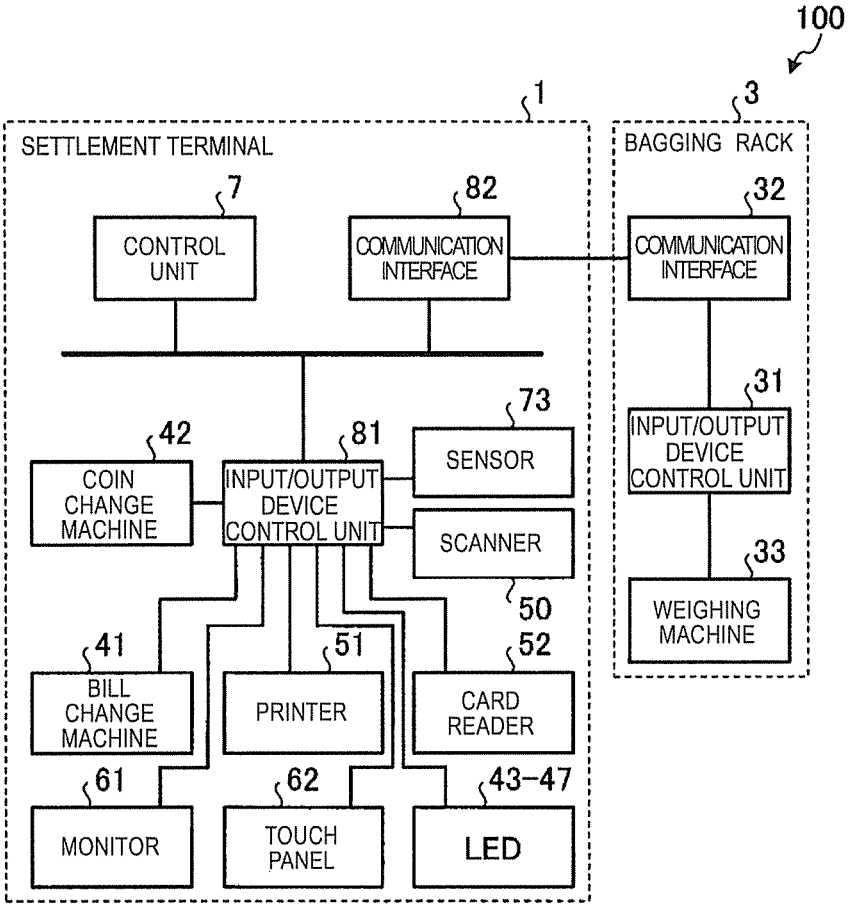
FIG. 5 is a block diagram illustrating a hardware configuration of the self-checkout apparatus.

Next, a hardware configuration of the self-checkout apparatus 100 is described. FIG. 5 is a block diagram illustrating the hardware configuration of the self-checkout apparatus 100.

As illustrated in FIG. 5, the settlement terminal 1 includes a control unit 7, an input/output device control unit 81, and a communication interface 82. The communication interface 82 connects the apparatus itself to the bagging rack 3 in a communicable manner. The input/output device control unit 81 connects the bill change machine 41, the coin change machine 42, the LEDs 43 to 47, the scanner 50, the printer 51, the card reader 52, the monitor 61, the touch panel 62, and the sensor 73 to the control unit 7.

On the one hand, the bagging rack 3 further includes an input/output device control unit 31, a communication interface 32, and a weighing machine 33. The weighing machine 33 is for weighing the weight of an object placed on the bagging rack 3. The communication interface 32 connects the apparatus itself to the settlement terminal 1 in a communicable manner. The input/output device control unit 31 connects the weighing machine 33 to the control unit 7 via the communication interfaces 32 and 82. The weighing machine 33 is for weighing the weight of the object on the bagging rack 3 for the purpose of preventing an unfair act.

The control unit 7 includes a Central Processing Unit (CPU), a Read Only Memory (ROM), and a Random Access Memory (RAM). The ROM stores various computer programs executed by the CPU and various kinds of data. The RAM temporarily stores data and computer programs when the CPU executes the computer programs. The control unit 7 collectively controls the respective components by developing and executing the computer programs, which are read by the CPU from the ROM, in the RAM.

The computer programs executed by the self-checkout apparatus 100 according to the present embodiment are also provided by being recorded in a computer-readable recording medium such as a CD-ROM, a flexible disk (FD), a CD-R, or a Digital Versatile Disk (DVD) as a file in an installable format or an executable format.

The computer programs executed by the self-checkout apparatus 100 according to the present embodiment may be configured to be provided by being stored on a computer connected to a network such as the Internet and being downloaded via the network. The computer programs executed by the self-checkout apparatus 100 according to the embodiment may be configured to be provided or distributed via a network such as the Internet.

The computer programs executed by the self-checkout apparatus 100 according to the embodiment may be configured to be provided in a state of being mounted in advance on a ROM or the like.

Figure 6:
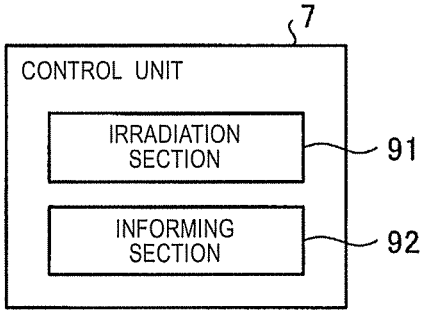
Figure 7:
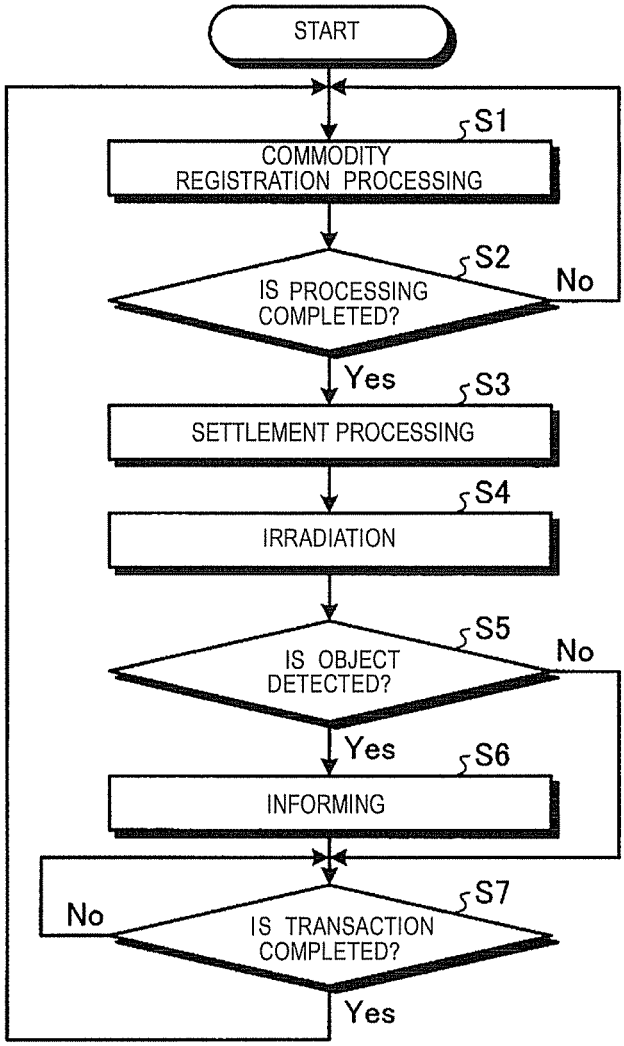
FIG. 7 is a flowchart illustrating a flow of the settlement processing.

Next, a settlement processing which is a characteristic function of the present embodiment in various kinds of processing executed by the control unit 7 of the settlement terminal 1 of the self-checkout apparatus 100 is described. FIG. 6 is a functional block diagram illustrating functions relating to the settlement processing, and FIG. 7 is a flowchart illustrating a flow of the settlement processing.

In the settlement processing, the control unit 7 of the settlement terminal 1 realizes the irradiation section 91 and the informing section 92 acting as functional units as illustrated in FIG. 6 in accordance with a computer program.

The irradiation section 91 controls the LED 47 to emit light to execute irradiation with light in accordance with the timing of dispensing of change from the coin change machine 42.

The informing section 92 informs that there is an object (wallet or coins) placed on or near the money placement surface 71 if the object is detected by the sensor 73 after completion of payment.

The settlement processing is described with reference to the flowchart illustrated in FIG. 7. As illustrated in FIG. 7, the control unit 7 of the settlement terminal 1 executes a commodity registration processing, first (Act S1).

The sales registration processing is described. If a customer holds an image (code symbol) in which a commodity code is coded over the scanner 50, the scanner 50 reads the code symbol to output the commodity code. If the scanner 50 outputs the commodity code, the control unit 7 refers to a Price Look Up (PLU) file stored in the apparatus itself or a storage unit of an external apparatus connected in on-line manner, for example. The PLU file records names, prices, and the like of commodities in association with commodity codes respectively in a table format, for example.

Then, the control unit 7 acquires information associated with the commodity code read by the scanner 50 in information recorded in the PLU file. Then, the information acquired is recorded as a commodity information, and the price of the commodity is added to a purchase amount. In this way, the commodity sales registration is performed.

Next, if the customer completes the commodity sales registration and bagging (Yes in Act S2), the control unit of the settlement terminal 1 performs the settlement processing (Act S3). If the customer does not complete the processing including the commodity sales registration (No in Act S2), the control unit 7 of the settlement terminal 1 returns to the commodity sales registration processing (Act S1).

The settlement processing is described. If an operation of proceeding to settlement is received from the customer, then the control unit 7 of the settlement terminal 1 displays a sum of the prices of the commodities sales-registered on the monitor 61. Immediately after, the control unit 7 of the settlement terminal 1 starts reception of a settlement operation by the customer.

In a cash settlement, if cash (money) is input or deposited through the bill inserting slit 411 of the bill change machine 41 and/or the coin inserting slot 421 of the coin change machine 42, the control unit 7 calculates a difference (change) between the money deposited and the sum displayed. If there is a change to be paid, the control unit 7 dispenses the change from the bill dispensing slit 412 of the bill change machine 41 and/or the coin dispensing dish 422 of the coin change machine 42.

The control unit 7 (irradiation section 91) of the settlement terminal 1 executes irradiation of the LED 47 in response to the timing of the cash-dispensing to the coin dispensing dish 422 of the coin change machine 42 (Act S4). As described above, with the execution of irradiation of the LED 47 at the timing of the cash-dispensing from the coin change machine 42, it is possible to prevent the customer (operator) from forgetting to pick up the coins dispensed to the coin dispensing dish 422.

If an object (wallet or coins) placed on or near the money placement surface 71 is detected immediately after completion of the payment by the customer (Yes in Act S5), the control unit 7 (informing section 92) of the settlement terminal 1 informs the customer of the detection result (Act S6). As an informing method, a sound (voice), a screen display, and an output of a signal to an attendant terminal (not shown) are exemplified. In this way, it is possible to prevent the customer from forgetting to pick up his or her wallet, the coins, and the like on or near the money placement surface 71. If no object (wallet or coins) is detected (No in Act S5), the control unit 7 (informing section 92) of the settlement terminal 1 directly proceeds to the processing in the Act S7.

The control unit 7 of the settlement terminal 1 completes one transaction at the time of completion of the settlement (Yes in Act S7) and moves to a standby state for waiting for a start of the next transaction (Act S1).

According to the settlement apparatus of the present embodiment, the customer does not need to pick up coins on the money placement surface 71 of the money placement portion 70 to move them, and can easily and smoothly perform the operation of depositing the coins on the money placement surface 71 into the coin change machine 42 through the coin inserting slot 421 as described above.

Although, in the present embodiment described above, the example in which the settlement terminal 1 of the self-checkout apparatus 100 through which a customer performs the commodity sales registration and the settlement by himself or herself is applied to as the settlement apparatus is described, the exemplary embodiment is not limited thereto. For example, an accounting machine that is installed at a semi-self-checkout lane and is used for the settlement processing by a customer after the commodity sales registration is performed by a store clerk may be applied to as the settlement apparatus.

Alternatively, a ticket vending machine (ticketing machine) for issuing tickets in a restaurant, a fare adjustment machine for a parking or a train station, or an automatic vending machine may be applied to as the settlement apparatus.

Although, in the present embodiment described above, the money placement portion 70 is provided at the left side of the coin inserting slot 421 as illustrated in FIG. 4, the exemplary embodiment is not limited thereto. In a case in which the coin inserting slot 421 is arranged at the left side, for example, the money placement portion 70 may be arranged at the right side of the coin inserting slot 421.

Although some embodiments of the invention are described above, these embodiments are presented for the illustrative purpose and are not intended to limit the scope of the invention. These novel embodiments may be formed in other various forms, and various omissions, replacements, and alterations may be made without departing from the gist of the invention. These embodiments and modifications thereof are included in the scope and the gist of the invention, and are also included in the invention described in claims and equivalents thereof.

What is claimed is:

1. A settlement apparatus comprising:

a case body;

a coin inserting slot, provided at the case body, which receives a deposited coin;

a coin depositing/dispensing device, provided in the case body, which stores the deposited coin received through the coin inserting slot and dispenses the stored coin; and a concaved shape money placement portion, arranged at the case body, which has a money placement surface on which the deposited coin which is received by the coin inserting slot is temporarily placed, wherein the money placement surface is connected to the coin inserting slot in a width direction of the case body and is formed flatly, and the money placement portion is arranged across a center of the case body in the width direction.

2. The settlement apparatus according to claim 1, wherein the money placement portion is provided at a position that is deeper than a bill inserting slit in a depth direction of the case body.

3. The settlement apparatus according to claim 1, wherein the money placement portion is provided at a position that is deeper than a bill dispensing slit in a depth direction of the case body.

4. The settlement apparatus according to claim 1, wherein the money placement portion is provided at a position that is deeper than a coin dispensing dish in a depth direction of the case body.

5. The settlement apparatus according to claim 1, wherein the money placement portion is provided at a position that is deeper than a reject dish in a depth direction of the case body.

6. The settlement apparatus according to claim 1, further comprising:

a bill inserting slit, wherein the coin inserting slot and the bill inserting slit are provided at positions between which there is an overlap in the width direction of the case body.

7. The settlement apparatus according to claim 1, further comprising:

a bill dispensing slit, wherein the coin inserting slot and the bill dispensing slit are provided at positions between which there is an overlap in the width direction of the case body.

8. The settlement apparatus according to claim 1, further comprising:

a bill inserting slit, wherein the bill inserting slit is provided below the concaved shape money placement portion in a height direction of the settlement apparatus.

9. The settlement apparatus according to claim 1, further comprising:

a display/operation unit, wherein the display/operation unit is provided above the concaved shape money placement portion in the height direction of the settlement apparatus.

10. The settlement apparatus according to claim 1, further comprising:

a scanner, wherein the scanner is provided above the concaved shape money placement portion in the height direction of the settlement apparatus.

11. The settlement apparatus according to claim 10, wherein the scanner is provided between the display/operation unit and the concaved shape money placement portion in the height direction of the settlement apparatus.

* * * * *